US012116096B2

(12) United States Patent
Benini et al.

(10) Patent No.: US 12,116,096 B2
(45) Date of Patent: Oct. 15, 2024

(54) PROPULSION DEVICE WITH OUTBOARD WATERJET FOR MARINE VEHICLES

(71) Applicant: SEALENCE S.P.A., Buccinasco (IT)

(72) Inventors: Ernesto Benini, Teolo (IT); William Gobbo, Buccinasco (IT)

(73) Assignee: SEALENCE S.P.A., Buccinasco (IT)

( * ) Notice: Subject to any disclaimer, the term of this patent is extended or adjusted under 35 U.S.C. 154(b) by 0 days.

(21) Appl. No.: 17/264,919

(22) PCT Filed: Jul. 31, 2019

(86) PCT No.: PCT/IB2019/056536
§ 371 (c)(1),
(2) Date: Feb. 1, 2021

(87) PCT Pub. No.: WO2020/026166
PCT Pub. Date: Feb. 6, 2020

(65) Prior Publication Data

US 2021/0309334 A1 Oct. 7, 2021

(30) Foreign Application Priority Data

Aug. 3, 2018 (EP) ..... 18187392

(51) Int. Cl.
*B63H 11/08* (2006.01)

(52) U.S. Cl.
CPC ..... *B63H 11/08* (2013.01); *B63H 2011/081* (2013.01); *B63H 2011/085* (2013.01)

(58) Field of Classification Search
CPC ..... B63H 11/08; B63H 2011/081; B63H 2011/084; B63H 2011/085; B63H 2023/005; F04D 3/00
See application file for complete search history.

(56) References Cited

U.S. PATENT DOCUMENTS 3,112,610 A * 12/1963 Jerger ..... B63H 5/14 60/221
3,143,972 A * 8/1964 Smith ..... B63H 11/08 440/47

(Continued)

FOREIGN PATENT DOCUMENTS

CN 1236347 A 11/1999
CN 101888948 A 11/2010

(Continued)

OTHER PUBLICATIONS

International Search Report of PCT/IB2019/056536.

(Continued)

*Primary Examiner* — Andrew Polay
(74) *Attorney, Agent, or Firm* — Rivka Friedman

(57) ABSTRACT

Propulsion device with outboard waterjet for marine vehicles, which comprises a nacelle (2) which at its interior houses a propeller (3) constituted by a pump (11) actuatable for generating a flow of fluid through the nacelle (2) according to an outflow sense (VF). The nacelle (2) comprises: a front dynamic intake (12) having passage sections substantially increasing according to the aforesaid outflow sense (VF), in a manner such to cause a slowing of the local speed of the fluid and a pressure rise; a rear discharge nozzle (14) having passage sections substantially decreasing in the outflow sense (VF) of the fluid, in a manner such to cause an increase of the local speed of the fluid and a pressure decrease, creating a propulsive thrust jet at the outlet of the discharge nozzle (14).

13 Claims, 4 Drawing Sheets

(56) References Cited

U.S. PATENT DOCUMENTS

| | | | | |
|---|---|---|---|---|
| 3,163,980 | A * | 1/1965 | Turner | B63H 11/12 60/221 |
| 3,906,886 | A | 9/1975 | Elger | |
| 4,281,996 | A | 8/1981 | Mouraret | |
| 5,273,467 | A | 12/1993 | Hall | |
| 5,462,460 | A | 10/1995 | Kobaysahi | |
| 5,846,103 | A | 12/1998 | Varney et al. | |
| 5,964,626 | A | 10/1999 | Varney et al. | |
| 6,135,831 | A * | 10/2000 | Lanni | F04D 29/2277 440/49 |
| 2005/0142001 | A1* | 6/2005 | Cornell | F04D 15/0022 417/244 |
| 2006/0248895 | A1 | 11/2006 | Muldoon | |
| 2009/0293795 | A1 | 12/2009 | Schroeder | |
| 2011/0074158 | A1 | 3/2011 | Schroeder | |
| 2020/0001960 | A1* | 1/2020 | Oran | B63H 1/16 |

FOREIGN PATENT DOCUMENTS

| | | | |
|---|---|---|---|
| CN | 102069347 | A | 5/2011 |
| CN | 102686477 | A | 9/2012 |
| CN | 105599887 | A | 5/2016 |
| CN | 107499487 | A | 12/2017 |
| CO | 00079701 | | 10/2000 |
| EP | 3604117 | | 2/2020 |
| GB | 759500 | | 10/1956 |
| GB | 759500 | A | 10/1956 |
| GB | 813786 | A | 5/1959 |
| GB | 1323871 | A | 7/1973 |
| JP | S6237296 | A | 2/1987 |
| JP | S4017261 | A | 8/1998 |
| JP | 2000168687 | A | 6/2000 |
| WO | 0112498 | A1 | 2/2001 |
| WO | 200220347 | | 3/2002 |

OTHER PUBLICATIONS

Search Report of European Application No. 18187392.
Office Action of Canadian Application No. 3066276 dated Mar. 17, 2021.
Office Action of Chilean Application No. 202100249 dated Dec. 6, 2021
Chinese Office Action of CN201780051310.7 mailed on Feb. 15, 2023.
Notice of Refusal for JP2021-505409 mailed on Jan. 10, 2023.
Colombian Office Action of NC2021/0001286 mailed on Apr. 20, 2023.

* cited by examiner

PROPULSION DEVICE WITH OUTBOARD WATERJET FOR MARINE VEHICLES

FIELD OF APPLICATION

The present finding regards a propulsion device with outboard waterjet for marine vehicles according to the preamble of the independent claim No. 1.

The present propulsion device is inserted in the field of jet propulsion systems for marine/ship use.

Advantageously, the present propulsion device is adapted for high-speed marine applications (preferably for speeds greater than 30-40 knots) and is intended to be employed, for example, in fast sports/pleasure crafts or commercial boats.

State of the Art

As is known, in the field of propulsion, propeller propulsion technology has for some time been employed. This technology conventionally has an outboard configuration, in which the propeller is outside the bottom of the ship and is moved by means of a mechanical transmission system that connects the propeller to an internal combustion engine. This propulsion technology, even if it has important advantages in terms of structural simplicity and flexibility, has strong limits with regard to attainable speeds and hence power concentration per unit of propulsive axle. The reason for such limits is tied to the fact that the propeller is an unducted propeller (i.e. it does not have a casing that separates it from the outside environment) and, hence, the maximum load that can be concentrated, in terms of power per unit of propeller shaft, is relatively small.

Also widespread in the marine vehicle field—even if of relatively more recent introduction—is waterjet propulsion technology, which substantially exploits the principle of action and reaction for advancing the ship by pumping the ambient water.

The waterjet propellers presently diffused in the fast ship/marine vehicle field (i.e. with navigation speeds greater than 30-40 knots) are, as known, of the so-called type with oblique inlet (or have intake of the flush type).

The aforesaid waterjet propellers are conventionally inserted in an onboard configuration, i.e. within the bottom of the ship, in whose bottom an intake duct is made which is extended from an inlet section (often termed "intake mouth" or more simply "mouth"), made in proximity to the stern/poop of the boat, followed by a section where a pump is situated which, in turn, is connected to a discharge nozzle. Within the intake duct, or better yet at a suitable distance from the mouth, a pump is arranged that is connected to an engine (typically internal combustion) and actuatable by the latter in order to pressurize the water so as to transport it, through the same intake duct, to the discharge nozzle where the speed increases, creating the propulsive effect that generates the advancing thrust of the ship.

The onboard waterjet propellers onboard of known type—even if they free the boat of pressing bulk constraints—suffer limitations regarding the level of the propulsive efficiency, of the specific thrust and of the anti-cavitation margin of the propeller, to an extent that is greater the higher the speed required by the boat.

Indeed, in onboard waterjet propellers, the water flow in the intake duct is not facilitated by the overall very long length of the latter, from which there follows the massive incidence of hydraulic pressure drops in the duct itself, which has considerable negative effect on the propulsive efficiency.

Outboard ram inlet propellers are also known, which nevertheless are not at all conceived for use at high sailing/navigation speeds. More in detail, the latter propellers of known type, also termed thrusters (bow-thruster, azimuth thruster, etc.), provide for the use of one or more ducted propellers in cylindrical or frustoconical ducts. Such thruster propellers (in which the propellers are actuated both by mechanical drive systems and by electrical systems) do not allow a thrust concentration (i.e. a thrust per unit of fluid flow rate carried out) that is at all sufficient to ensure sailing/navigation speeds greater than 20 knots, and therefore they are only suitable for use for low-speed propulsion (lower than 20 knots), e.g. for port maneuvering operations or for slow sailing/navigation. The aforesaid propellers thruster, regardless of the shape that they take on, technically cannot fall within the category of waterjets, since they employ a simple configuration with ducted propeller, without the use of any jet propeller.

Therefore, in the field of marine vehicle propulsion, there is the need for outboard propulsion systems with ram inlet which allow increasing the performances in terms of speed and propulsive power, in relation to precise design choices.

Document GB 759,500 discloses a known propulsion device for shallow draft vessels, which comprises a hollow cylindrical stator provided with an intake cowl having an intake aperture, and with a discharge cowl having a discharge opening. Further, the propulsion device comprises a rotor provided with rotary blades and mounted on a shaft pivoted to the stator and connected to an electric engine. The propulsion device disclosed in GB 759,500 is not suitable for high-speed applications, but it is exclusively intended for low speed boats or flatboats, because, in particular, it lacks an appropriated hydrodynamic configuration for minimizing drug phenomena at high speeds.

Presentation of the Invention

In this situation, the problem underlying the present invention is therefore that of overcoming the drawbacks manifested by the abovementioned solutions of known type, by providing a propulsion device with outboard waterjet for marine vehicles capable of ensuring high advancing speeds.

Further object of the present invention is to provide a propulsion device with outboard waterjet for marine vehicles capable of ensuring a high propulsive efficiency.

Further object of the present invention is to provide a propulsion device with outboard waterjet for marine vehicles capable of preventing problems tied to the cavitation phenomenon.

Further object of the present invention is to provide a propulsion device with outboard waterjet for marine vehicles which is entirely efficient and reliable in operation.

BRIEF DESCRIPTION OF THE DRAWINGS

The technical characteristics of the invention, according to the aforesaid objects, can be clearly seen in the contents of the below-reported claims and the advantages thereof will be more evident in the following detailed description, made with reference to the enclosed drawings, which represent several merely exemplifying and non-limiting embodiments of the invention, in which:

DETAILED DESCRIPTION OF SEVERAL PREFERRED EMBODIMENTS

Figure 1:
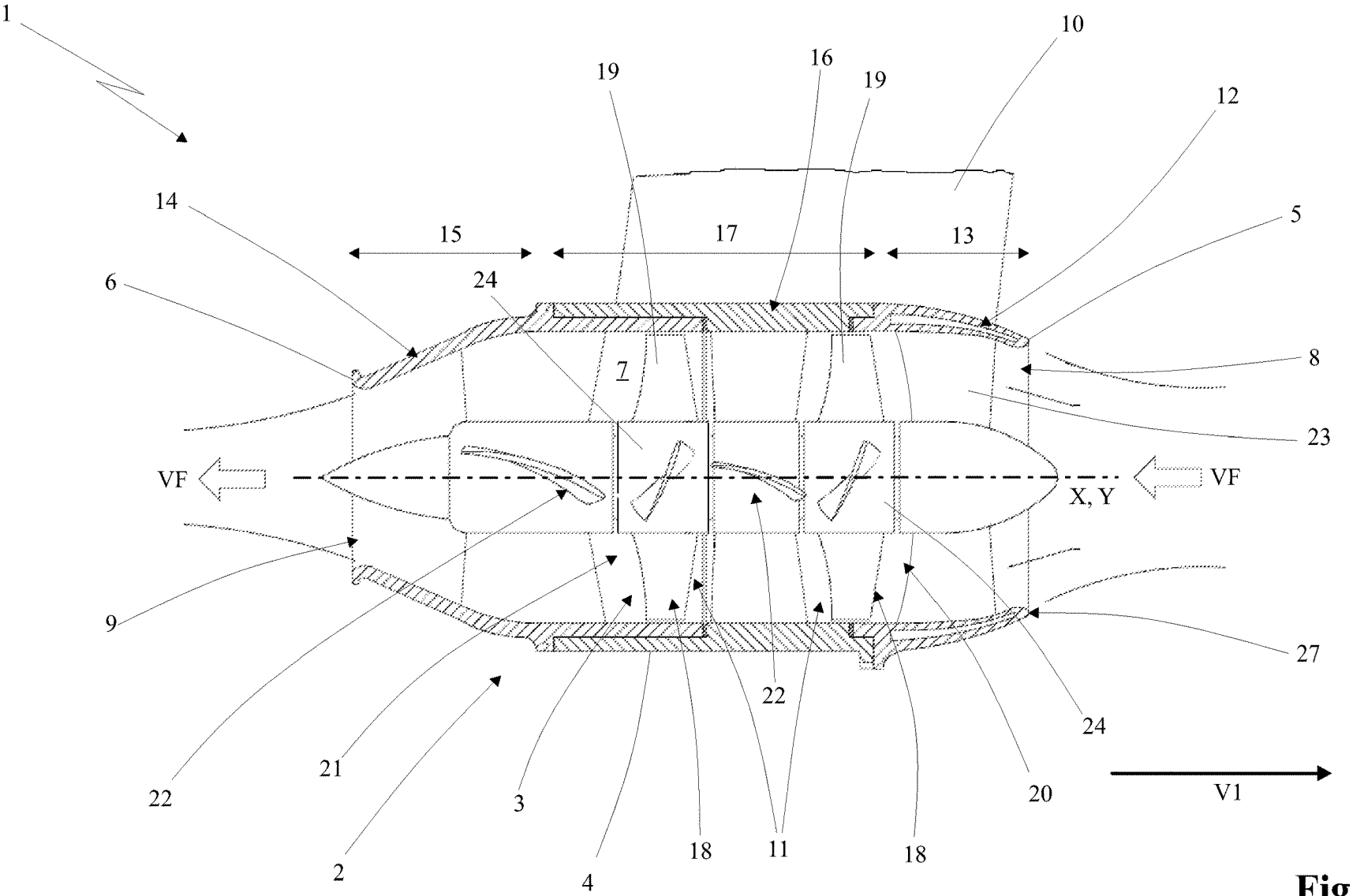
FIG. 1 shows a schematized representation of the propulsion device in a sectional view according to a meridional view, in accordance with a first embodiment of the present invention having in particular outlet stator guide vanes and impeller of the type with hub.

With reference to the enclosed drawings, reference number 1 overall indicates a propulsion device with outboard waterjet for marine vehicles, object of the present invention.

In particular, the present propulsion device 1 is arranged for attaining a configuration that is entirely outboard, in which the propulsion device 1 is installed at the exterior of the bottom of the ship hull, in a manner such that it can be frontally hit by the water during the advancing of the ship.

According to the present invention, the propulsion device 1 comprises a nacelle 2 (also termed "shuttle" in the technical jargon) and a propeller 3 housed within such nacelle 2. More in detail, the nacelle 2 comprises a housing 4, preferably with hydrodynamic shape, (in particular with substantially tubular shape) and preferably but not necessarily entirely axially-symmetric, with longitudinal axis intended to be arranged substantially horizontal.

In particular, the housing 4 is extended axially between a front end 5 and an opposite rear end 6 along an extension direction X, advantageously rectilinear, and preferably coinciding with the longitudinal axis of the housing 4 itself.

In addition, the housing 4 of the nacelle 2 is provided with a conveyance channel 7, which is extended along the aforesaid extension direction X between an inlet section 8, which is arranged at the front end 5 of the housing 4, and an opposite outlet section 9, which is arranged at the rear end 6 of the housing 4.

The nacelle 2 is intended to be connected to the exterior of the bottom of the ship, in a manner such to be completely immersed within the fluid (in particular a liquid) of the body of water on which the ship itself is intended to advance.

In particular, the nacelle 2 is intended to be fixed to the bottom of the ship for example by means of a support fin 10, in a manner per se known to the man skilled in the art.

The propeller 3 is arranged within the conveyance channel 7 of the housing 4 of the nacelle 2 and is actuatable for generating a jet of fluid which exits from the outlet section 9 of the housing 4 and which determines, by reaction, a propulsion in a specific advancement direction V1 substantially transverse to the inlet section 8 of the housing 4. In accordance with the idea underlying the present invention, the propeller 3 comprises at least one pump 11 actuatable for generating a flow of fluid through the conveyance channel 7 of the housing 4 according to an outflow sense VF which goes from the inlet section 8 (front) to the outlet section 9 (rear) of the housing 4.

In particular, the pump 11 is arranged for pressurizing the fluid in a considerable manner, allowing the attainment of a net and finite pressure rise between the fluid that is upstream of the pump 11 and the fluid downstream thereof.

The nacelle 2 of the propulsion device 1, according to the invention, comprises a front dynamic intake 12, adapted to receive the fluid which comes from the inlet section 8 of the housing 4.

More in detail, the dynamic intake 12 comprises a front section 13 (preferably tubular) of the housing 4, said front section 13 being shaped in a suitable hydrodynamic manner, which is extended axially along the extension direction X of the housing 4 itself between the inlet section 8 of the latter and the pump 11.

The dynamic intake 12, and in particular its front section 13, is extended starting from the inlet section 8 of the housing 4 towards the pump 11. The inlet section 8 is arranged in a manner such that its lying plane is, preferably but not necessarily, orthogonal to the advancement direction V1, such that such inlet section 8 (and the dynamic intake 12) is directly exposed to the current during the advancing of the ship.

The front section 13 of the dynamic intake 12 has passage sections, obtained transverse to the extension direction X of the housing 4, which are substantially increasing according to the outflow sense VF of the fluid, i.e. according to a sense of the extension direction X which goes from the front end 5 towards the rear end 6 of the housing 4. In this manner, such configuration with increasing section of the dynamic intake 12 causes, at its interior, an average slowing of the fluid speed and a consequent pressure rise, i.e. a diffusion, of the fluid itself. Of course, without departing from the protective scope of the present patent, the dynamic intake 12 can be provided with further sections (downstream and/or upstream of the aforesaid front section 13) which can have non-increasing section (e.g. constant section).

Advantageously, moreover, the need to ensure suitable operating flexibility of the propeller device 1 as a function of the sailing/navigation speed obliges that the front section 13 of the dynamic intake 12 be connected to the external surface of the housing 4 of the nacelle 2 by means of a lip 27 of suitably rounded shape, which delimits the edge of the inlet section 8 of the nacelle 2. Said rounding of the lip 27 can determine, according to its own shape, a limited and circumscribed local narrowing of the passage sections starting from the inlet section 8 of the nacelle 2, without causing a distorting of the diffusive functions of the dynamic intake 12 in its entirety.

In operation, the dynamic intake 12, with its progressively increasing passage sections, diffuses the fluid current, slowing the speed thereof and recovering pressure, and possibility eliminating or mitigating possible non-uniformities that could be present in the current that arrives inside the conveyance channel 7 of the nacelle 2.

In substance, therefore, the function of the dynamic intake 12 is that of slowing the current, recovering static pressure, maintaining the flow of the fluid uniform and allowing the latter to arrive in front of the pump 11 with a lower speed than that of an undisturbed flow outside the nacelle 2.

The nacelle 2 also comprises a rear discharge nozzle 14, adapted to accelerate the pressurized fluid current from the pump 11 at speeds significantly greater than that of sailing/navigation, thus allowing the obtainment of a reactive effect that allows the propulsion in the advancement direction V1.

More in detail, the discharge nozzle 14 comprises a substantially axially-symmetric (preferably tubular) rear section 15 of the housing 4, which is extended axially along the extension direction X between the pump 11 and the outlet section 9 of the housing 4, in particular terminating at the outlet section 9 itself.

The rear section 15 of the discharge nozzle 14 has passage sections, obtained transverse to the extension direction X, which are decreasing in the outflow sense VF, in a manner so as to cause, within the discharge nozzle 14, an increase of the local speed of the fluid and a consequent pressure decrease of the latter, creating a propulsive thrust jet exiting from the outlet section 9 of the housing 4 of the nacelle 2.

In this manner, in particular, the discharge nozzle 14 has the function of accelerating in an efficient manner, and simultaneously extremely spatially compact, the fluid current so to be able to obtain the reactive effect for the propulsion.

Of course, without departing from the protective scope of the present patent, the discharge nozzle 14 can be provided with further sections (downstream and/or upstream of the aforesaid rear section 15) which can have non-decreasing (e.g. constant) section.

Advantageously, the nacelle 2 comprises a central body 16 arranged between the dynamic intake 12 and the discharge nozzle 14 and containing the pump 11 at its interior.

More in detail, the aforesaid central body 16 comprises an intermediate section 17 (preferably tubular) of the housing 4, which is extended axially along the extension direction X between the front section 13 of the dynamic intake 12 and the rear section 15 of the discharge nozzle 14. Such intermediate section 17, which at its interior houses the pump 11, has passage sections, obtained transverse to the extension direction X of the housing 4, advantageously (but not necessarily) having substantially constant area along such extension direction X.

Advantageously, the pump 11 is provided with at least one impeller 18 having rotation axis Y parallel to the extension direction X of the housing 4 of the nacelle 2.

Suitably, the inlet section 8, and preferably also the outlet section 9, of the housing 4 lie on corresponding lying planes that are substantially orthogonal to the rotation axis Y of the impeller 18, which in particular crosses such sections 8, 9. The impeller 18 of the pump 11 is provided with blades 19 having airfoil, in particular with the chord preferably increasing, which increases as a function of the radius of the impeller 18, such to considerably pressurize the fluid within the nacelle 2, and which allows attaining a finite pressure jump between the fluid upstream and downstream of the pump 11.

Figure 2:
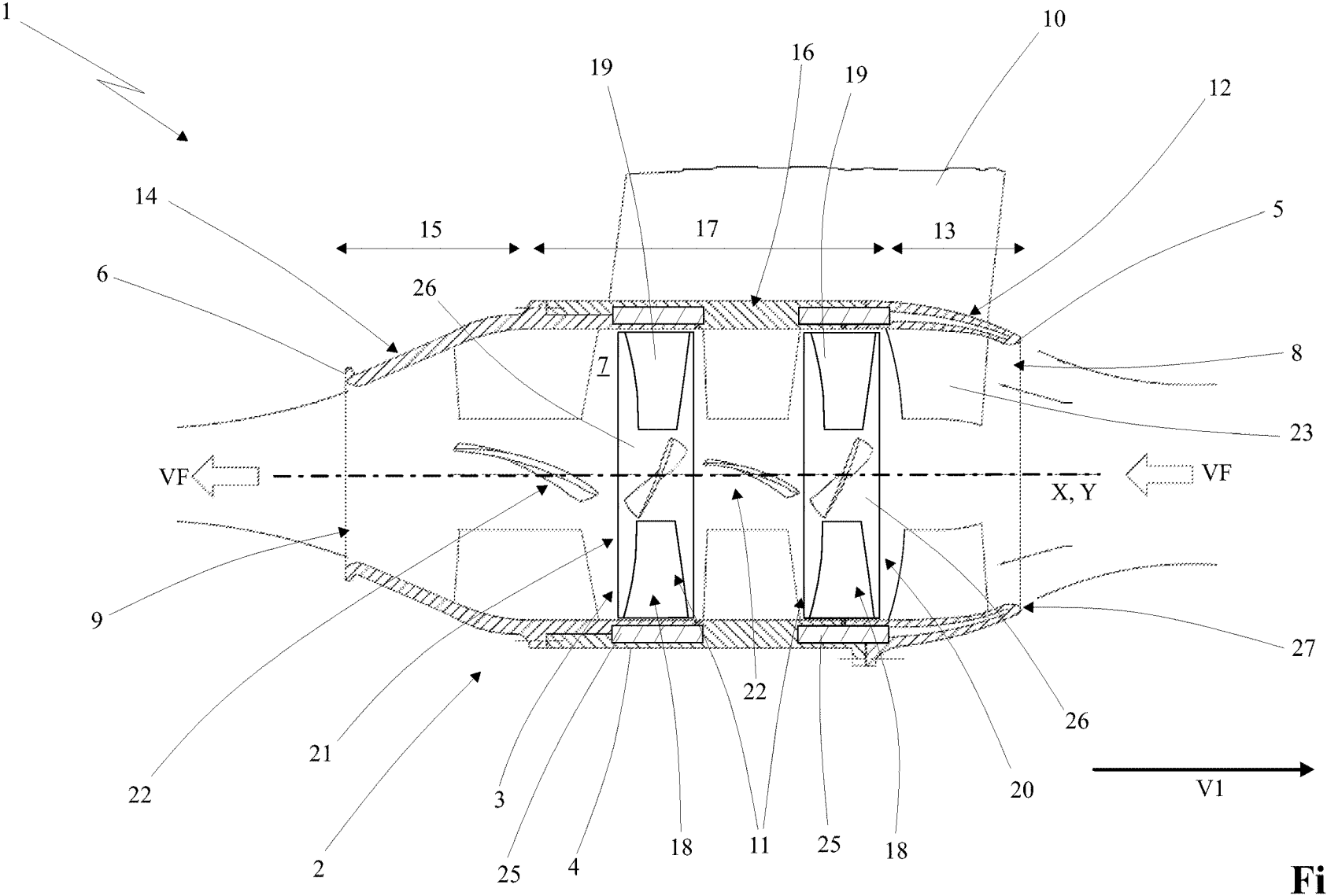
FIG. 2 shows a schematized representation of the propulsion device in a sectional view according to a meridional view, in accordance with a second embodiment of the present invention having in particular outlet stator guide vanes and impeller of hubless type.
Figure 3:
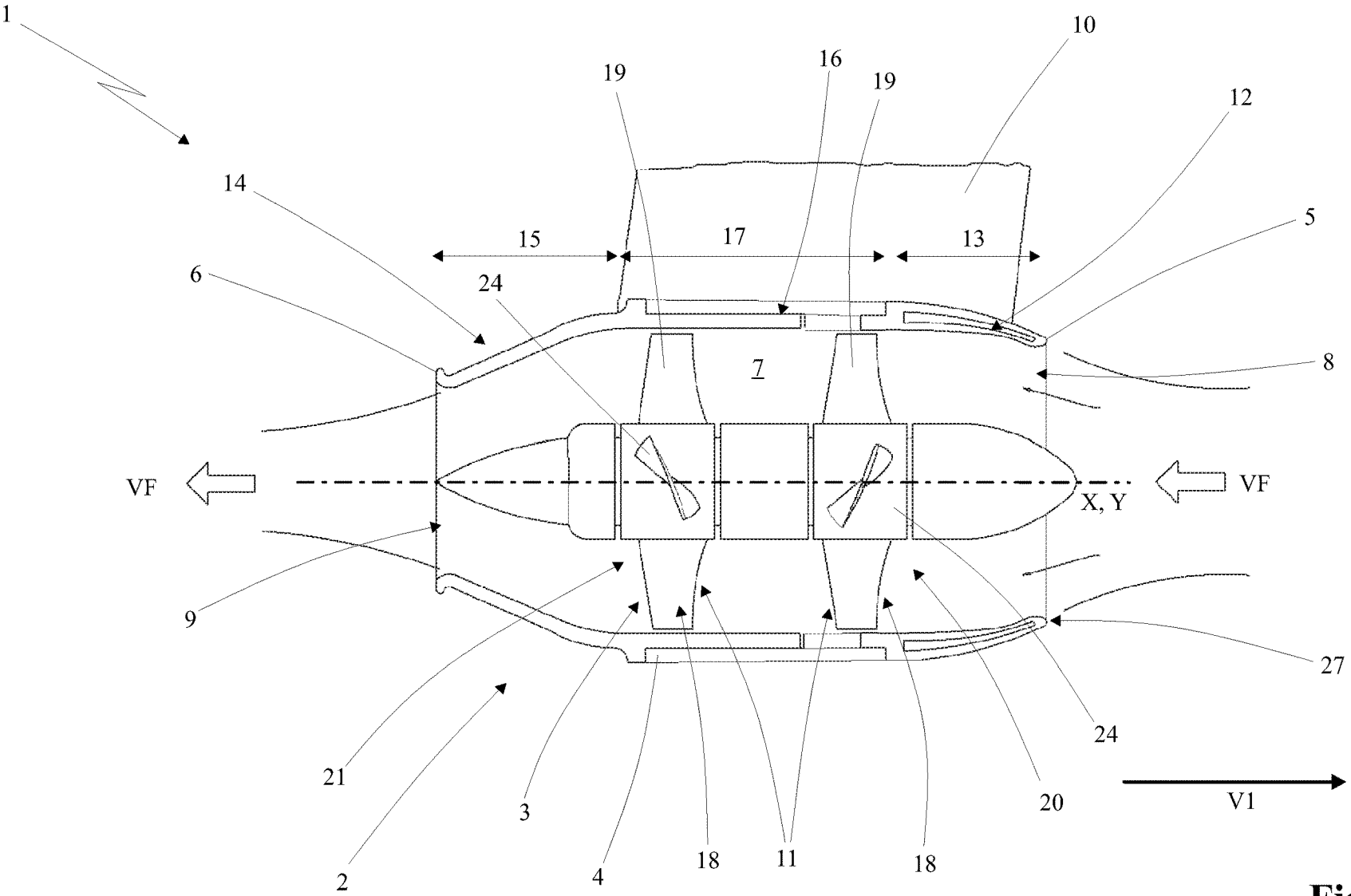
FIG. 3 shows a schematized representation of the propulsion device in a sectional view according to a meridional view, in accordance with a third embodiment of the present invention in particular lacking outlet stator guide vanes and having impeller of the type with hub.
Figure 4:
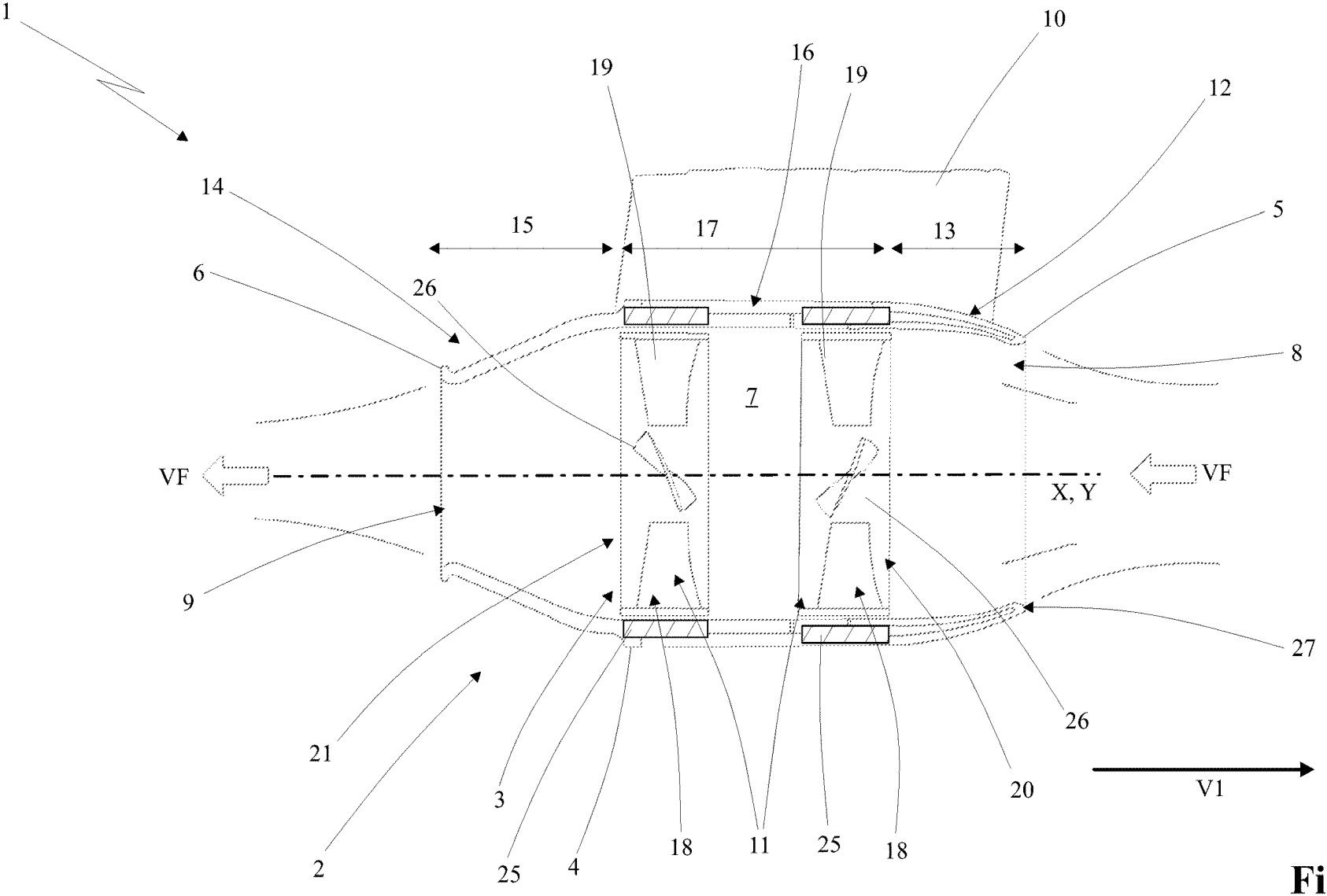
FIG. 4 shows a schematized representation of the propulsion device in a sectional view according to a meridional view, in accordance with a fourth embodiment of the present invention in particular lacking outlet stator guide vanes and having impeller of hubless type.

Advantageously, the impeller 18 can be provided with a central hub 24 which carries the blades 19 (as in the examples of FIGS. 1 and 3) fixed thereto, or it can be of "hubless" type (as in the examples of FIGS. 2 and 4). In particular, the impeller 18 of "hubless" type lacks hub and comprises a peripheral ring which is extended around the rotation axis Y, is rotatably constrained in the conveyance channel 7 of the housing 4 in order to rotate around said rotation axis Y, and carries the blades 19 fixed thereto; more in detail, each blade 19 is extended between a (free) internal end directed towards the rotation axis Y and an external end fixed to the aforesaid peripheral ring.

Preferably, the pump 11 is an axial flow pump, or a semi-axial flow pump (also termed mixed flow pump). The shape of the rotor blading 18 provides for the presence of a blade-carrier hub 24, or disc, in the conventional configuration of axial flow pump or mixed flow pump. However, if the pump 11 is hubless, the bladed shape still meets the hydrodynamic requirements of the impellers with axial flow or mixed flow, except that the blading is peripherally fixed to a blade carrier ring.

The arrangement of the pump 11 of axial or semi-axial type allows processing relatively high volumetric flow rates in relation to the head, such condition indispensable for ensuring the highest possible value for the propulsive efficiency and, consequently, a reduction of the consumptions.

Advantageously, the pump 11 comprises two or more stages arranged in succession along the extension direction X of the housing 4 of the nacelle 2, and each of such stages is provided with a corresponding impeller 18.

Of course, the impellers 18 of the different stages of the pump 11 can have different configurations as a function in particular of their operating characteristics.

Preferably, in accordance with the embodiments illustrated in the enclosed figures, the pump 11 comprises a first stage 20 with function mainly as an anti-cavitating inducer, and a subsequent second stage 21 with mainly power function.

In particular, the first stage 20 is positioned, along the extension direction X of the housing 4, immediately downstream of the dynamic intake 12 (with respect to the outflow sense VF), and it is arranged for generating a first pressure rise of the fluid in order to partially pressurize the fluid flow at a pressure such to prevent the cavitation within the blade channels of the first stage 20 and downstream of the latter, maintaining a relatively low head. The second stage 21 is positioned between the first stage 20 and the discharge nozzle 14, in particular immediately upstream of the latter. Such second stage 21 is arranged for generating a second pressure rise of the fluid greater than the first pressure rise generated by the first stage 20, in a manner such to obtain a greater head and obtain the desired propulsive thrust, substantially without risking cavitation problems.

In this manner, in particular, the two stages 20, 21 arranged in series allow dividing the head into two parts, entrusting the first stage 20 with the function of anti-cavitating inducer, attributing a fraction thereto suitably lower than 50% of the overall head of the pump 11 so as to in any case prevent the cavitation of the entering flow, while the subsequent second stage 21 has the function of actual power, being crossed by a fluid current that is suitably pressurized and hence substantially immune to cavitation.

With reference to such double stage solution (probably the most suitable for this purpose), it is important to define the "bond" between the two stages 20, 21, i.e. the overall fraction of head required for the propulsion to be attributed to each stage 20, 21. In particular, since the function of the two stages 20, 21 differs, in relation to the characteristics of the flow that crosses them, the problems that condition the design procedure thereof are also different.

More specifically, the impeller 18 of the first stage 20, being exposed to a flow with low pressure (comparable with that of the external environment where the propeller device 1 works), is configured for preventing cavitational phenomenon, by means of the limiting of the NPSH (Net Positive Suction Head) required by the pump 11 and, the other conditions being the same, by means of a strict control of the flow velocities in the relative frame at the tip. Hence, the impeller 18 of the first stage 20 has the function of "anti-cavitating pre-inducer", i.e. of "booster", attributing a relatively small fraction of the head of the pump 11 thereto, in order to prevent the danger of blade stall and, simultaneously, in order to prevent the danger of cavitation. The impeller 18 of the second stage 21, being subjected to a previously-pressurized flow and taking on the load of the greater head level, is in particular configured so as to oppose blade stall. Such second stage 21 performs the actual power function task.

Preferably, with reference in particular to the examples of FIGS. 1 and 2, the propulsion device 1 comprises at least one bladed diffuser 22 fixed to the housing 4 of the nacelle 2, arranged within the conveyance channel 7 downstream of the impeller 18 of the pump 11 with respect to the outflow sense VF. In particular, with reference to the embodiments exemplified in FIGS. 1 and 2, two bladed diffusers 22 are provided, one for each stage 20, 21, and arranged downstream of the impellers 18 of the corresponding stages 20, 21.

Each bladed diffuser 22 is arranged for conveying the fluid, pressurized by the impeller 18, in axial direction along the extension direction X of the housing 4.

In particular, the bladed diffuser 22 has the function of substantially canceling the tangential component of the fluid velocity and conveying it in axial direction.

Advantageously, the propulsion device 1 comprises multiple inlet guide vanes 23 fixed to the housing 4 of the nacelle 2 and positioned within the conveyance channel 7 between the inlet section 8 of the housing 4 and the pump 11, in particular within the dynamic intake 12.

Such inlet guide vanes 23 are arranged for turning the fluid according to at least one tangential velocity component with respect to the rotation of the impeller 18 of the pump 11 around the rotation axis Y.

In detail, the inlet guide vanes 23 comprise fixed multiple blades arranged upstream of the impeller 18, in particular of the first stage 20 of the pump 11. The function of such inlet guide vanes 23, in addition to structural stiffening, can be likened to that of an inlet guide. In such case, the inlet guide vanes 23 can be shaped by means of aerodynamic airfoils that are symmetric or with curvilinear median line. In both cases, the inlet guide vanes 23 have the function of turning the fluid current, conferring a tangential velocity component thereto at the entrance to the impeller 18 of the first stage 20, with the objective of reducing the size of the flow velocity in the relative frame at the entrance to the impeller 18 of such first stage 20, with positive effects on the stall and cavitation behavior of the pump 11.

Advantageously, the propulsion device 1 comprises at least one motor operatively connected to the propeller 3 in order to actuate the pump 11 of the latter. In particular, the motor is operatively connected to the impeller 18 of the pump 11 in order to make it rotate around its rotation axis Y.

The motor of the propulsion device 1 is preferably of electric type and can be advantageously connected to the impeller 18 of the pump 11 by means of mechanical transmissions (analogous to propeller systems) or by means of a direct-drive and in particular rim-driven configuration (described in detail hereinbelow).

In particular, said electric motor can have onboard configuration, in which the motor is arranged within the bottom of the ship and is connected to the impeller 18 of the pump 11 by means of mechanical transmissions, or the electric motor can have outboard configuration, in which the motor is arranged outside the bottom of the ship and in particular within the nacelle 2. In the outboard configuration, for example, the electric motor can be arranged within the hub 24 of the impeller 18 (in the case of impeller 18 with hub) or around the impeller 18 itself in the rim-driven configuration (both in the case of impeller with hub and lacking hub).

In particular, with reference to the examples of FIGS. 2 and 4, the electric motor in rim-driven configuration comprises an annular stator 25 fixed to the housing 4 of the nacelle 2 and arranged around the impeller 18 coaxial with the rotation axis Y of the latter, and an annular rotor 26, which is rotatably mounted within the conveyance channel 7 of the housing 4, is arranged coaxial with the rotation axis Y and carries the blades 19 of the impeller 18 fixed thereto. The rotor 26 is coupled to the stator 25, in a manner such that, when the latter is supplied with electric current, it generates a magnetic field that rotates the rotor 26 (and hence the impeller 18) around the rotation axis Y, in accordance with the known operating principle of electric motors. Preferably, in the case of impeller 18 of "hubless" type, the rotor 26 is associated with the peripheral ring of the impeller 18 itself or constitutes such peripheral ring.

Preferably, in the case of multiple pumps or pump 11 with multiple stages, the propulsion device 1 can comprise multiple motors, operatively independent, each of which connected to the impeller 18 of the corresponding stage 20, 21 of the pump 11, in order to configure the operation of the two stages 20, 21 so as to configure the above-described specific functions of the latter (in particular anti-cavitation and power).

Advantageously, each impeller 18 is independently actuatable by the corresponding electric motor, such that the torque delivered to the impeller 18 of the first stage 20 can be independent from that provided to the impeller 18 of the second stage 21, thus allowing an optimal power delivery management during the operating transients of the propeller 3 or in sailing/navigation speed conditions that are different from the nominal conditions.

Hereinbelow, several of the possible embodiments of the present invention are described in detail and are illustrated in the enclosed figures.

FIG. 1 illustrates a first embodiment of the present invention, in which the impellers 18 of the pump 11 are provided with hub 24 on which the corresponding blades 19 are fixed. In particular, in such first embodiment, the nacelle 2 is provided with fixed blades of the bladed diffuser 22.

Advantageously, with reference to the example of FIG. 1, the two stages 20, 21 of the pump 11 are each composed of a succession of an impeller 18 (bladed) and of an annular formation of fixed blades which act as bladed diffuser 22. Advantageously, the blades of the bladed diffuser 22 of both the stages 20, 21 are shaped by employing blade sections constituted by specifically-designed aerodynamic airfoils.

The actuation of the two impellers 18 can be obtained by means of a mechanical transmission drive (e.g. of the type employed in propeller systems), or, preferably and alternatively, by means of a direct-drive system via electric motors, outside of the nacelle 2 or inside the same. In the latter case, the electric motor may be housed within the hub 24 of the impeller 18 and the transmission of the motion can occur with or without the interposition of reduction members. Still with reference to possible embodiments, another possible placement of the electric motor can still be within the nacelle 2, arranged outside the impellers 18 and connected thereto (rim-driven).

The two-stage configuration thus delineated allows obtaining a fluid current which, downstream of the bladed diffuser 22 of the second stage 21, is arranged in axial direction, maximizing the propulsive efficiency of the propulsion device 1. In such configuration, the substantially axially-symmetric front section 13 of the dynamic intake 12 has the function of guiding the flow from the inlet section 8 of the nacelle 2 to the interface surface with the impeller 18 of the first stage 20, allowing a suitable slowing of the current, with consequent recovery of static pressure and simultaneously with minimum pressure drops and minimum distortion level of the flow (the non-uniformities of the current entering the impeller 18 being minimized). In addition, the discharge nozzle 14, placed downstream of the second stage 21, has the function of accelerating the pressurized current from the impeller 18 of the second stage 21 to speed values considerably greater than the sailing/navigation speed, thus allowing the obtainment of a reactive effect that allows a high-speed propulsion (greater than 30-40 knots).

In accordance with a second embodiment of the present invention, illustrated in FIG. 2, the impeller 18 of the pump 11 lacks hub (hubless). In particular, also in such second embodiment, the nacelle 2 is provided with fixed blades of the bladed diffuser 22.

The advantages of the hubless configuration of the impeller 18 will be clear in light of the following considerations. In the outboard configuration of the propulsion device 1, pressing radial bulk requirements of the nacelle 2 can determine overly slender sizes of the hub of the impeller 18. Indeed, given the same flow rate value (as said this must be considerable), any attempt to reduce the main section of the propeller 3, for a simultaneous decrease of its hydrodynamic drag upon advancement, can in some cases give rise to a drastic and dangerous reduction of the hub size: in fact the configuration of the current within the pump 11, e.g. according to the "free vortex" model, would imply an excess angular turning of the relative current, in the zone of the hub, thus exposing the blade airfoils adjacent thereto to the danger of blade stall. Simultaneously, there is the possible danger of cavitation which can easily involve the tip blading, where the fluid is affected by relative speeds that are higher the higher the pump specific speed, as generally occurs, in the presence of high flow rates and rotation operating speeds that are also relatively high (if it is desired to avoid the use of a reducer, or at least limit the reduction ratio thereof). Also on such matter, the configuration of the current according to the free vortex model, i.e. vortical distributions comparable to the mild forced vortex, have shown to be rather "rigid", allowing small margins for limiting the NPSH required by the pump.

Due to the abovementioned grounds, as well as based on other criteria such as, for example, the opportunity to be able to easily evacuate relatively voluminous objects that have penetrated within the propeller 3, or based on criteria that aim to reduce the noise of the propeller 3, the configuration of the impeller 18 of the pump 11 lacking hub (hubless) is particularly advantageous; one example thereof is represented by the second embodiment of the invention illustrated in FIG. 2.

Advantageously, also in such second embodiment, preferably two stages 20, 21 of the pump 11 are provided, each composed of a succession of an impeller 18 (bladed) and of an annular formation of fixed blades, which act as bladed diffuser 22. In the absence of a hub for housing a mechanical drive shaft for transmitting motion to the impellers 18, in this case, the actuation of the two impellers 18 occurs by means of a system with electric motors. In the example of FIG. 2, the solution of rim-driven type is illustrated, already known in the art, in which the rotor 26 of the electric motor acts as a support for housing the blades 19 of the impeller 18. In particular, the blade 19 of the impeller 18, of one or more of the stages 20, 21, is anchored at its base integrally with the surface of the ring of the rotor 26 of the electric motor, while the stator 25 of the electric motor is housed within the housing 4 of the nacelle 2. In this manner, the blades 19 of the impeller 18—rather than being integrally fit on a hub and extended in radial direction from the center of the latter towards the periphery, as in a conventional axial turbo flow pump—are integrally fixed to the ring of the rotor 26 and are extended in the direction opposite the preceding, i.e. substantially from the outside to the inside. Advantageously, in the hubless solution exemplified in the second embodiment of FIG. 2 (and in a fourth embodiment illustrated in FIG. 4, discussed hereinbelow), the blades 19 of the impeller 18 terminate in proximity to a finite and non-zero radial height, with end (tip) provided with aerodynamic airfoils arranged on an imaginary surface of substantially cylindrical type.

Preferably, also in the aforesaid second embodiment of FIG. 2, the pump 11 has a double pump configuration or two-stage pump configuration that allows easily obtaining a current that, downstream of the bladed diffuser 22 of the second stage 21, is arranged in axial direction, maximizing the propulsive efficiency of the propulsion device 1.

Also in such second embodiment of FIG. 2, the dynamic intake 12 and the discharge nozzle 14 allow obtaining the technical effects and the advantages indicated above for example in the discussion of the first embodiment of FIG. 1.

The invention thus conceived therefore attains the pre-established objects.

FIGS. 3 and 4 respectively illustrate a third and a fourth embodiment of the present invention in which the two impellers 18 of the pump 11 are in a counter-rotating configuration, respectively with impellers 18 of the type with hub (example of FIG. 3) and hubless type (example of FIG. 4).

Such third and fourth embodiments, for the common characteristics, are based on the operating principles and structural considerations already amply mentioned and described in the previous paragraphs and detailed in the discussion of the first and second preferred embodiments.

Advantageously, in the aforesaid third and fourth preferred embodiments of the invention, the two impellers 18 of the pump 11 rotate in opposite sense with respect to each (counter-rotating impellers), thus allowing the elimination of the formations of bladed diffusers 22 present in the examples of FIGS. 1 and 2. In such a manner, it is possible to obtain a head concentration, significantly reducing the axial extension of the propeller 3, with clear benefits in terms of weight and bulk reduction. As a further advantage, the solution equipped with counter-rotating impellers 18 allows the nearly complete straightening (deswirl) of the absolute current exiting from the impeller 18 of the second stage 21, which is thus arranged nearly parallel to the direction of the longitudinal axis of the nacelle 2, with clear advantages in terms of propulsive efficiency. Also with the use of the counter-rotating impellers 18, the configuration of the impeller 18 of the pump 11 lacking hub (hubless) is particularly advantageous, the example thereof being represented in the fourth embodiment illustrated in FIG. 4.

Advantageously, there can be a total elimination of the bladed diffusers, as represented in the examples of FIGS. 3 and 4, or there can be a selective elimination, i.e. eliminating only one or more bladed diffusers 22 present in the examples of FIGS. 1 and 2, thus configuring findings which are in turn new and different variants with respect to that described for the first and second preferred embodiments exemplified in FIGS. 1 and 2, and with respect to that described for the third and fourth preferred embodiments exemplified in FIGS. 3 and 4.

The invention therefore achieves the pre-established objects, both in the above-described preferred embodiments and in all the possible variants deriving from that described above.

The invention claimed is:

1. A propulsion device with outboard waterjet for high-speed marine vehicles, the propulsion device comprising:

a nacelle comprising a housing with hydrodynamic shape, to be connected to exterior of a bottom of a ship in order to be immersed within a fluid in which said ship is intended to advance, wherein said housing is extended axially according to an extension direction (X) between a front end and a rear end, and is provided with a conveyance channel, which is extended along said extension direction (X) between an inlet section, arranged at said front end, and an opposite outlet section arranged at said rear end;

a propeller arranged within the conveyance channel of said housing and actuatable in order to determine a propulsion in a specific advancement direction (V1) substantially transverse to the inlet section of said housing;

wherein:

said propeller comprises a pump actuatable for generating a flow of said fluid through said conveyance channel according to an outflow sense (VF) which goes from said inlet section to said outlet section; wherein said pump is provided with at least one impeller having a radius and a rotation axis (Y) parallel to the extension direction (X) of said housing;

said nacelle comprises:

a dynamic intake, which comprises a substantially axially-symmetric front section of said housing; wherein said front section is extended axially along said extension direction (X) between said inlet section and said pump, and has passage sections, transverse to said extension direction (X), increasing according to said outflow sense (VF), in a manner such to cause, in said dynamic intake, a slowing of local speed of said fluid and a pressure rise of said fluid;

a discharge nozzle, which comprises a substantially axially-symmetric rear section of said housing; wherein said rear section is extended axially along said extension direction (X) between said pump and said outlet section, and has passage sections, transverse to said extension direction (X), decreasing in said outflow sense (VF), in a manner such to cause, in said discharge nozzle, an increase of the local speed of said fluid and a pressure decrease of said fluid, creating a propulsive thrust jet exiting from said outlet section;

a central body comprising an intermediate section of said housing; wherein said intermediate section is extended along said extension direction (X) between said dynamic intake and said discharge nozzle, at its interior houses said pump and has passage sections, transverse to said extension direction (X), having constant area along said extension direction (X);

wherein the front section of said dynamic intake has an inner surface which is connected to an external surface of the housing of said nacelle by means of a lip whose longitudinal profile has a convex rounded shape, said lip defining an edge of the inlet section of said nacelle; wherein said convex rounded shape of the lip determines a limited and circumscribed local narrowing of the passage sections starting from the inlet section of said nacelle;

wherein said convex rounded shape of said lip has a curvature that decreases from said inlet section towards the inner surface of the front section of said dynamic intake;

wherein the longitudinal profile of the inner surface of said front section has a curved concave shape, which extends from said lip to said intermediate section and is linked to said convex rounded shape of said lip in an inflection point which is placed upstream of said propeller;

wherein the longitudinal profile of the external surface of said housing has, along said front section, a curved convex shape, which extends from said lip to said intermediate section and is smoothly linked with the convex rounded shape of said lip.

2. The propulsion device of claim 1, wherein the inlet section of said housing lies on a lying plane substantially orthogonal to the rotation axis (Y) of said at least one impeller.

3. The propulsion device of claim 1 wherein said pump is an axial flow pump or a semi-axial flow pump.

4. The propulsion device of claim 1, wherein said pump comprises two or more stages positioned in succession along the extension direction (X) of said housing, and each of said stages is provided with a corresponding said at least one impeller.

5. The propulsion device of claim 4, wherein said two or more stages of said pump comprises:

a first stage, arranged for generating a first pressure rise of said fluid;

a second stage, positioned between said first stage and said discharge nozzle, and arranged for generating a second pressure rise of said fluid greater than said first pressure rise.

6. The propulsion device of claim 5, wherein said first stage comprises a first impeller and said second stage comprises a second impeller, and the first impeller of said first stage is arranged for rotating in the sense opposite the sense of the second impeller of said second stage.

7. The propulsion device of claim 1, further comprising at least one electric motor operatively connected to said pump in order to actuate rotation of said at least one impeller.

8. The propulsion device of claim 7 wherein said pump comprises two or more stages positioned in succession along the extension direction (X) of said housing, and each of said stages is provided with a corresponding impeller of said at least one impeller;

the propulsion device further comprising multiple said electric motors, operatively independent, each of which is connected to the corresponding impeller of a corresponding said stage of said pump.

9. The propulsion device of claim 7, wherein said electric motor comprises:

an annular stator fixed to said housing and coaxial with the rotation axis (Y) of said at least one impeller;

an annular rotor, which is rotatably mounted within the conveyance channel of said housing, is positioned coaxial with said rotation axis (Y), carries said at least one impeller fixed thereto, and is coupled to said annular stator.

10. The propulsion device of claim 1, further comprising a bladed diffuser which is fixed to the housing of said nacelle, is positioned within said conveyance channel downstream of said impeller with respect to said outflow sense (VF), and is arranged for conveying said fluid in axial direction along the extension direction (X) of said housing.

11. The propulsion device of claim 1, further comprising multiple inlet guide vanes, which are fixed to the housing of said nacelle, are positioned within said conveyance channel between said inlet section and said pump, and are arranged for turning said fluid according to at least one tangential velocity component with respect to a rotation of said impeller.

12. The propulsion device of claim 1, wherein said at least one impeller comprises a central hub aligned with said rotation axis (Y) and multiple blades fixed to said central hub.

13. The propulsion device of claim 1, wherein said at least one impeller comprises:

a peripheral ring, which is extended around said rotation axis (Y), and is rotatably constrained in the conveyance channel of said housing in order to rotate around said rotation axis (Y);

multiple blades, each of which is extended between an internal end directed towards said rotation axis (Y) and an external end fixed to said peripheral ring.

* * * * *